US006428131B1

(12) United States Patent
Fujii et al.

(10) Patent No.: US 6,428,131 B1
(45) Date of Patent: Aug. 6, 2002

(54) IMAGE FORMING APPARATUS DETERMINING PRESENCE/ABSENCE OF INK WHILE MOVING INK CARTRIDGE

(75) Inventors: Yoshiharu Fujii, Sakurai; Satoru Fukuda, Nara; Shoji Yoshioka, Kashihara, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/271,460

(22) Filed: Mar. 18, 1999

(30) Foreign Application Priority Data

Mar. 25, 1998 (JP) ..... 10-076787

(51) Int. Cl.[7] ..... B41J 2/195; B41J 29/393; B41J 23/00

(52) U.S. Cl. ..... 347/7; 347/19; 347/37

(58) Field of Search ..... 347/7, 19, 37, 347/85, 86

(56) References Cited

U.S. PATENT DOCUMENTS 5,975,688 A * 11/1999 Kanaya et al. ..... 347/86

FOREIGN PATENT DOCUMENTS

EP 0744295 A1 * 11/1996 ..... 347/19
JP 05050611 2/1993 ..... 347/85

* cited by examiner

*Primary Examiner*—John Barlow
*Assistant Examiner*—An H. Do
(74) *Attorney, Agent, or Firm*—George W. Hartnell, III; David G. Conlin; Edwards & Angell LLP

(57) ABSTRACT

An image forming apparatus allowing accurate determination as to whether printing is possible or not in an actual printing operation includes an ink cartridge filled with ink, a cartridge holder for holding the ink cartridge, an ink sensor provided at a known position within a recordable range of a sheet, and a control unit for controlling the cartridge holder and the ink cartridge such that ink is emitted from the nozzle of said ink cartridge at the position of the ink sensor while the cartridge holder is moved with a prescribed acceleration.

8 Claims, 3 Drawing Sheets

IMAGE FORMING APPARATUS DETERMINING PRESENCE/ABSENCE OF INK WHILE MOVING INK CARTRIDGE

BACKGROUND OF THE INVENTION

1. Field of the Invention

The present invention relates to an image forming apparatus and, more specifically, to an image forming apparatus which determines presence/absence of ink while an ink cartridge is being moved.

2. Description of the Background Art

In an image forming apparatus, a mechanism for determining whether image formation is possible or not is important. In a thermal head printer, whether image formation is possible or not is determined by monitoring a state of conduction. In a laser printer and in an ink jet printer, whether image formation is possible or not is determined by determining presence/absence of toner and ink, respectively.

In an ink jet printer, presence/absence of the ink is determined by supplying power to an ink cartridge (conduction method), or by simulating ink jetting (jet method).

The jet method includes a method of determining presence/absence of ink by visually monitoring the state of ink jetting directly, and a method in which a specific pattern is printed on a sheet and presence/absence of the ink is determined from the printed pattern.

In the conventional method of determining presence/absence of ink by visually monitoring the state of ink jet directly includes a method in which the ink cartridge is moved to a position where a sensor is provided, outside a printing area, the ink cartridge is stopped there, the ink is jet out, and presence/absence of the ink is detected.

It should be noted, however, that the state of the ink in the ink cartridge when the cartridge is stopped is different from the state of actual printing. In the actual printing, printing is performed while the ink cartridge is moving. Therefore, the ink in the ink cartridge is influenced by acceleration. If the remaining ink is small in amount, all the remaining ink is biased on a sidewall of the ink cartridge and there is no ink left at the nozzle position. Thus, ink is not emitted. When the ink cartridge is stopped or moving at a constant speed, the ink is not influenced by acceleration. Therefore, even if only a small amount of ink is left, the ink may be emitted.

Therefore, even if it is determined by the conventional method that there is the ink, there may be cases where the ink is not emitted in actual printing operation.

Further, the nozzle position of the ink cartridge differs slightly cartridge by cartridge. Therefore, when the ink jet position for detecting presence/absence of the ink is predetermined with the ink cartridge position being used as a reference, ink jet may not be detected by a sensor when the ink is actually emitted but not jetted at a precise position. In such a case, it may be erroneously determined that the ink is used up, even when there remains sufficient ink.

Further, a mechanical loss (back lash at a gear portion and tension of a timing belt) at the time of activation may cause variation in the position of the ink cartridge itself. In such a case also, jetting of ink to a precise position is difficult, and hence it may be erroneously determined that the ink is not present even if the ink still remains.

SUMMARY OF THE INVENTION

The present invention was made to solve the above described problems and its object is to provide an image forming apparatus and a method of positioning an ink sensor, allowing accurate determination as to whether printing is possible or not in actual printing operation.

Another object of the present invention is to provide an image forming apparatus and a method of positioning an ink sensor capable of absorbing variation in nozzle position of ink cartridges to enable ink jetting at a precise position, and allowing accurate determination of ink presence/absence.

A still further object of the present invention is to provide a facsimile apparatus by which data of importance is never erased even if printing of the data should fail.

According to an aspect, the present invention provides an image forming apparatus including: a cartridge holder holding an ink cartridge filled with ink; an ink sensor provided at a known position within a recordable range of a sheet of paper; and a control unit for controlling the cartridge holder and ink cartridge such that while the cartridge holder is moved with a prescribed acceleration, the ink is jetted from a nozzle of the ink cartridge at the position of the ink sensor.

The ink is emitted to the ink sensor while the ink cartridge is being moved at a prescribed acceleration. Therefore, presence/absence of the ink can be determined under the same condition as the actual printing. Therefore, whether printing is possible or not in actual printing operation can be detected accurately.

Preferably, the image forming apparatus further includes a unit for detecting whether the ink cartridge is attached to the cartridge holder or not. The control unit includes a first unit for causing ink jet from the nozzle of the ink cartridge near the ink sensor for calculating distance between a normal position of the cartridge, holder to the ink sensor, and a unit for controlling the cartridge holder and the ink cartridge such that the ink is emitted from the nozzle of the ink cartridge at the position of the ink sensor while the cartridge holder is moved with a prescribed acceleration, based on the distance calculated by the first unit.

Accurate distance from the normal position of the cartridge holder to the ink sensor is measured by the first unit. Therefore, it is possible to jet out the ink at a precise position, absorbing variation in nozzle position among the ink cartridges, and hence it is possible to accurately determine presence/absence of the ink.

More preferably, the image forming apparatus further includes a unit for detecting whether the ink cartridge is attached to the cartridge holder or not, and a holder sensor provided between the ink sensor and the normal position of the cartridge holder for detecting passage of the cartridge holder. The control unit includes a first unit for causing ink jet from the nozzle of the ink cartridge near the ink sensor for calculating a distance from the holder sensor to the ink sensor, and a unit for controlling the cartridge holder and the ink cartridge such that the ink is emitted from the nozzle of the ink cartridge at the position of the ink sensor while the cartridge holder is moved with a prescribed acceleration, based on the distance calculated by the first unit.

The accurate distance from the holder sensor to the ink sensor is measured by the first unit. Therefore, it is possible to emit ink at a precise position, absorbing variation in nozzle position among the ink cartridges, and therefore it is possible to accurately determine ink presence/absence.

According to another aspect, the present invention provides a facsimile apparatus including a data preparing unit for preparing data to be printed; an image forming apparatus connected to the data preparing unit for forming an image of the data; and data erasing unit for erasing the data after the image is formed. The image forming apparatus includes: a cartridge holder for holding an ink cartridge filled with ink; an ink sensor provided at a known position within a recordable range of a sheet of paper; and a control unit for controlling the cartridge holder and the ink cartridge such that ink is emitted from a nozzle of the ink cartridge at a position of the ink sensor based on the data, while the cartridge holder is moved with a prescribed acceleration.

The ink is emitted to the ink sensor while the ink cartridge is moved with a prescribed acceleration. Therefore, it is possible to determine whether the ink is present/absent under the same condition as the actual printing. Therefore, it is possible to accurately determine whether printing is possible or not in the actual printing operation. Further, as it is possible to accurately determine as to whether printing is possible or not in advance, the problem of erroneous erasure of important data when printing fails can be avoided.

According to a still further aspect, the present invention provides a method of positioning an ink sensor, used in an image forming apparatus including a cartridge holder for holding an ink cartridge filled with ink, an ink sensor provided at a known position within a recordable range of a sheet of paper, and a unit for determining whether the ink cartridge is attached to the cartridge holder. The method of positioning the ink sensor includes the steps of: when the ink cartridge is exchanged, moving the cartridge holder from a normal position of the cartridge holder to approximately a position of the ink sensor; causing ink jetting from the nozzle of the ink cartridge while swinging the cartridge holder over a prescribed width; detecting ink jetting by the ink sensor; and calculating a distance from the normal position of the cartridge holder to the ink sensor in accordance with the result of detecting by the ink sensor.

As the ink is emitted while the cartridge holder swings near the ink sensor, accurate distance between the normal position the cartridge holder to the ink sensor can be found. Therefore, it is possible to find an accurate ink sensor position, absorbing variation of the nozzle position among the ink cartridges.

According to a still further aspect, the present invention provides a method of positioning an ink sensor used for an image forming apparatus including an ink cartridge filled with ink, a cartridge holder holding the ink cartridge, an ink sensor provided at a known position within a recordable range of a sheet, a holder sensor provided between the ink sensor and a normal position of the cartridge holder for detecting passage of the cartridge holder, and a unit for detecting whether the ink cartridge is attached to the cartridge holder. The method of positioning the ink sensor includes the steps of: when the ink cartridge is exchanged, moving the cartridge holder from the normal position of the cartridge holder to approximate position of the ink sensor; detecting, by the holder sensor, passage of the cartridge holder; emitting ink from a nozzle of the ink cartridge while swinging the cartridge holder over a prescribed width, detecting by the ink sensor, jetting of the ink; and calculating distance between the holder sensor to the ink sensor in accordance with the result of detection by the ink sensor.

As the ink is emitted while the cartridge holder swings near the ink sensor, accurate distance from the holder sensor to the ink sensor is calculated. Therefore, it is possible to find accurate ink sensor position, absorbing variation of nozzle position among the ink cartridges.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

The facsimile apparatus in accordance with an embodiment of the present invention will be described in the following with reference to the figures.

Figure 1:
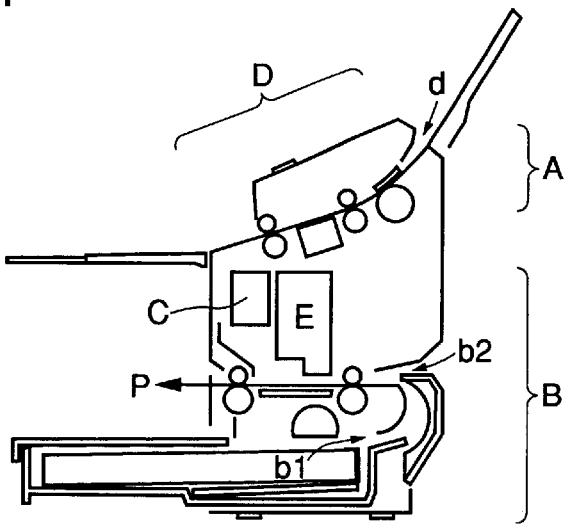
FIG. 1 shows a structure of a facsimile apparatus having an ink jet printer in accordance with an embodiment of the present invention.

Referring to FIG. 1, the facsimile apparatus having an ink jet printer includes a reading unit A for reading an original; an ink jet printer B for printing received information and read information; a communication converting unit C for transmitting read information and for converting received information to information printable by ink jet printer B; an operating unit D receiving instructions of reading and transmission by a user; and a control unit E for controlling reading unit A, ink jet printer B, communication converting unit C and operating unit D. Control unit E includes a memory for storing various information.

An original introduced from an original inlet opening d is read by reading unit A and discharged. A sheet of paper is conveyed from a paper cassette b1 or from a manual paper feed unit b2 to paper conveyer path P. Printing is done while the sheet of paper is being conveyed, by ink jet printer B.

Printing at the time of receiving a facsimile is done automatically without any manual help. Therefore, it is necessary to automatically detect whether the ink is present/absent in the ink cartridge, before starting printing. If printing starts without detecting presence/absence of the ink, the received information may possibly be lost.

Figure 2:
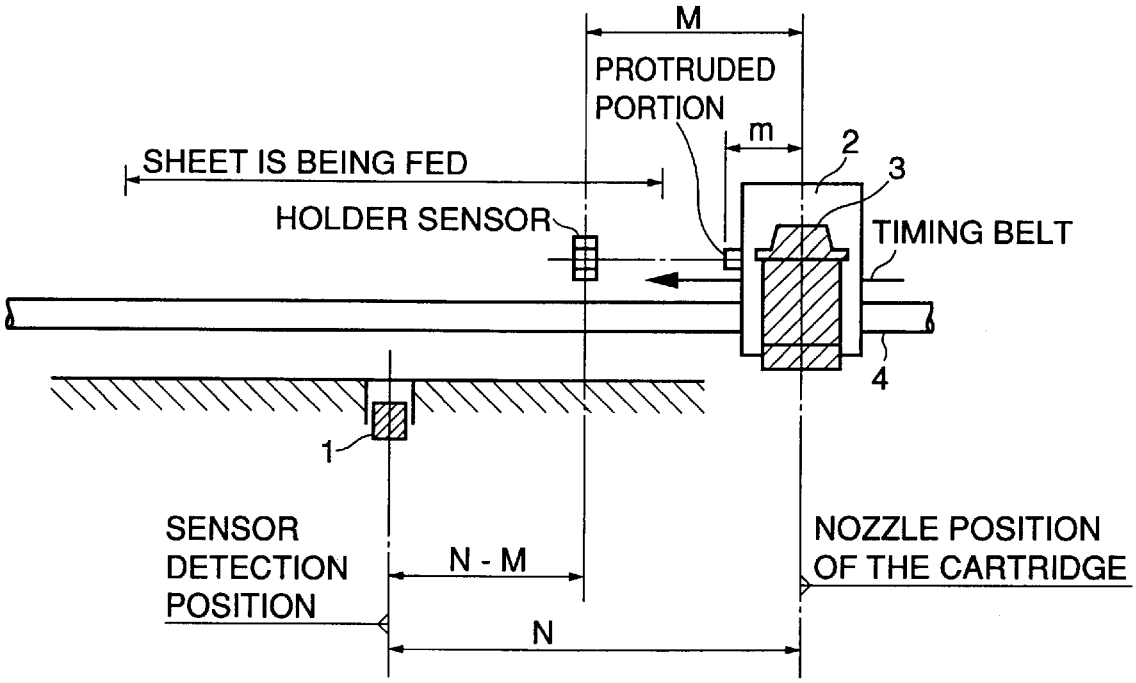
FIG. 2 shows a partial structure of the ink jet printer.
Figure 3:
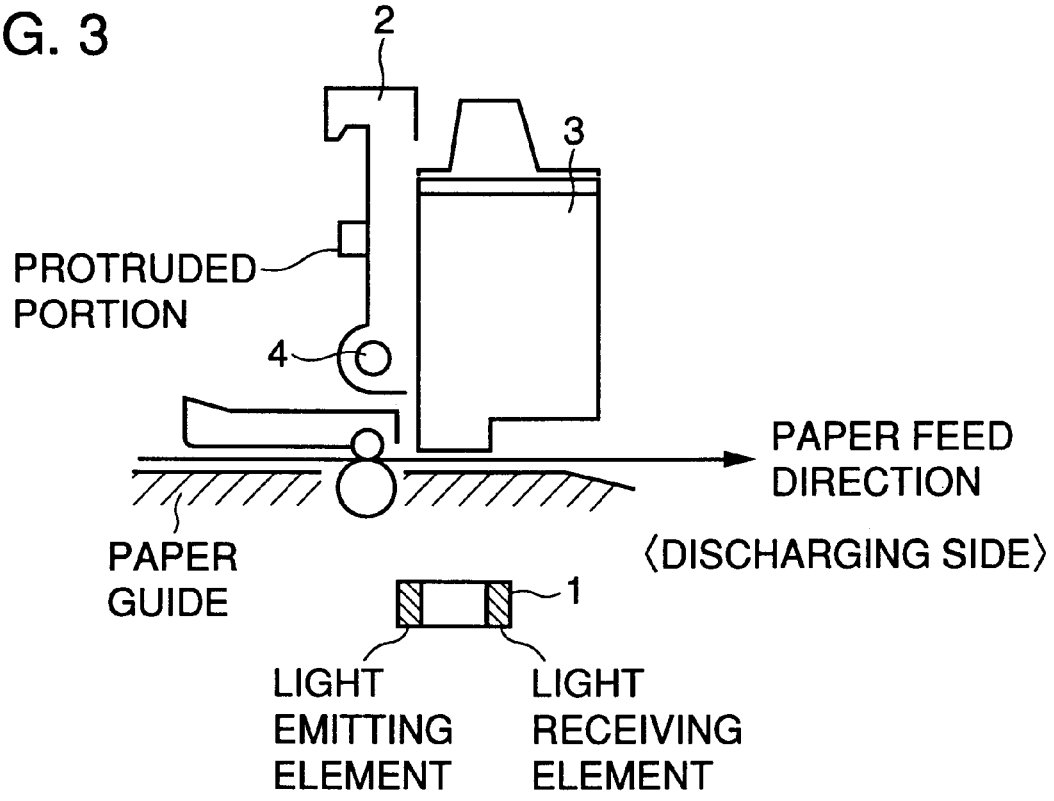
FIG. 3 is a side view of the ink jet printer shown in FIG. 2.

Referring to FIGS. 2 and 3, ink jet printer B includes an ink cartridge 3 filled with ink, a cartridge holder 2 for holding ink cartridge 3, and a shaft 4 provided for moving cartridge holder 2. Cartridge holder 2 has a protruded portion.

Ink jet printer B further includes a holder sensor for detecting passage of the protruded portion, and a photo interrupter (ink sensor) 1 for detecting whether the ink is jetted out from a nozzle (not shown) of ink cartridge 3 or not. Photo interrupter 1 is arranged at a known position within a recordable range of the sheet.

Let us represent the distance between the nozzle of ink cartridge 3 to the holder sensor as M and the distance between the nozzle of ink cartridge 3 to photo interrupter 1 as N. The distance from the nozzle of ink cartridge 3 to a tip end of the protruding portion is represented as m.

When ink cartridge 3 is exchanged, the distances M and N held in the memory of control unit E are erased. Distances are calculated using the present position of ink cartridge 3 (normal position) as a reference. Thereafter, ink cartridge 3 is moved to the left of FIG. 2 in accordance with an instruction from control unit E. Control unit E continuously monitors the distance of ink cartridge 3 from the normal position. Passage of cartridge holder 2 is detected by the holder sensor. The distance from the holder sensor to the photo interrupter 1 is known in advance. Therefore, control unit E moves ink cartridge 3 such that the nozzle position of ink cartridge 3 is placed approximately at the sensing or detecting position of photo interrupter 1. Thereafter, control unit E swings ink cartridge 3 by a prescribed width 2 W to the left and to the right from that position. Ink cartridge 3 emits ink while swinging. The distance (N-M) from the position where photo interrupter 1 detects ink to the position of the holder sensor is stored in the memory of control unit E.

When presence/absence of the ink is to be detected thereafter, ink jet is given at an accurate position based on the distance (N-M) from the holder sensor, whereby accurate determination of ink presence/absence is possible.

Figure 4:
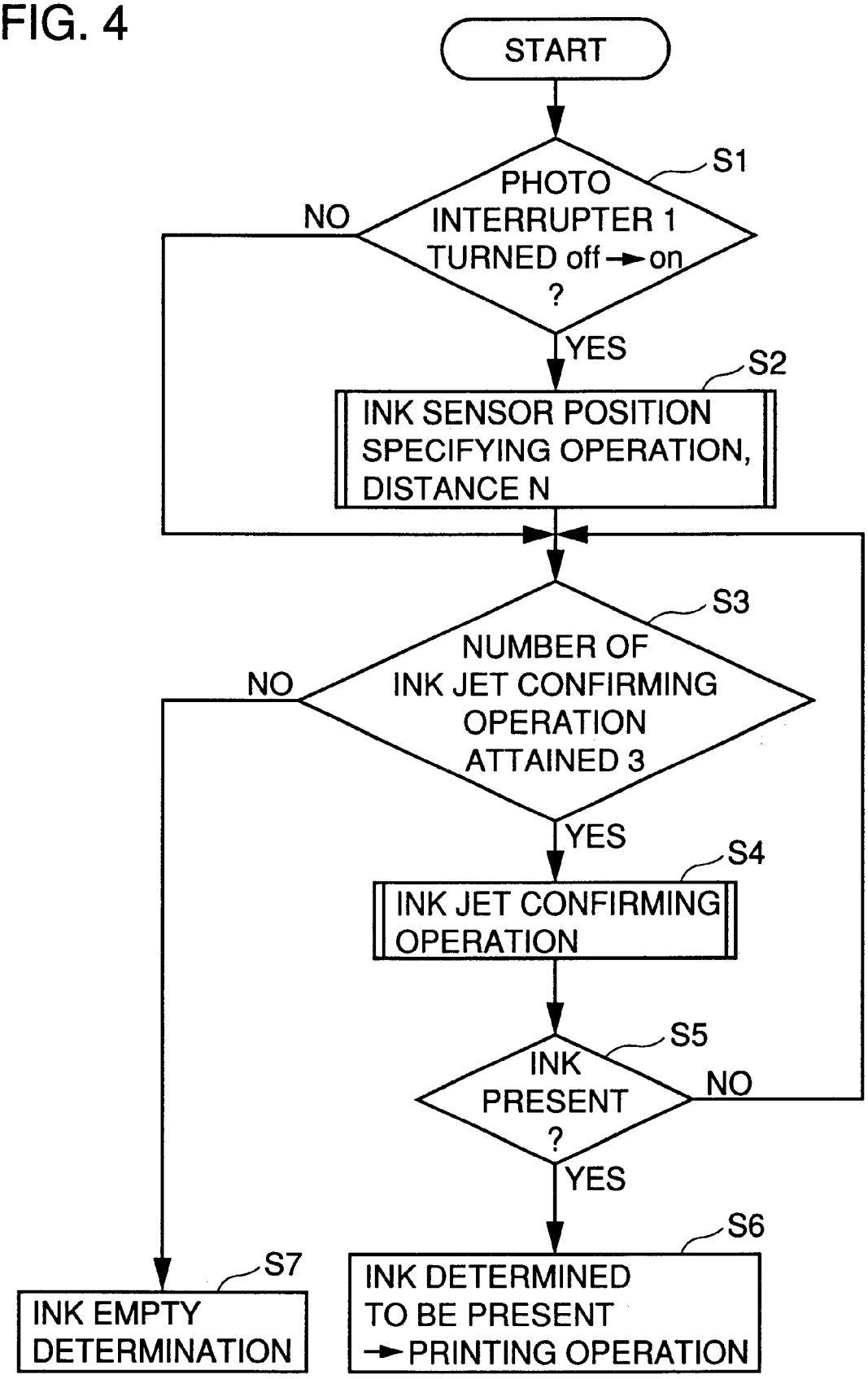
FIG. 4 is a flow chart of a process for calculating an accurate distance N from a normal position of an ink cartridge 3 to a photo interrupter 1.

In an ink jet printer E not provided with the holder sensor, approximate distance from the normal position of ink cartridge 3 to photo interrupter 1 is stored in the memory of control unit E. Referring to FIG. 4, an operation for calculating the distance N of ink jet printer E will be described.

When ink cartridge 3 is exchanged, control unit E guides ink cartridge 3 to the position of photo interrupter 1, and swings ink cartridge 3 to the left and right by the width of 2 W. In this period, ink cartridge 3 emits ink. When photo interrupter 1 detects ink (YES in S1), the distance N from the position where photo interrupter 1 detected the ink to the normal position of the ink cartridge 3 is stored in the memory of control unit E (S2).

When ink jet from ink cartridge 3 is not recognized (NO in S1), or after the process step of S2, control unit E determines whether the process step S4, which will be described later, has been performed upto three times or not (S3). If the step S4 has been repeated four times or more (NO in S3), it is determined that ink cartridge 3 is empty (S7). If the step S4 is repeated not more than three times (YES in S3), the step S4 is performed. Namely, ink cartridge 3 is moved from the normal position to a position at a distance N and ink is emitted under the influence of acceleration from ink cartridge 3 to photo interrupter 1 to confirm presence of the ink. In this operation, ink cartridge 3 is not swung to the left and right. Control unit E determines whether the ink is detected by photo interrupter 1 (S5). If photo interrupter 1 has not detected ink (NO in S5), the flow returns to the step S3.

If the ink is detected by photo interrupter 1 (YES in S5), control unit E determines that the ink is present in ink cartridge 3, and starts printing operation (S6).

When the presence/absence of the ink is to be detected thereafter, the ink is emitted at an accurate position based on the distance N, and determination of ink presence/absence is performed accurately.

In the facsimile apparatus in accordance with the present invention, presence/absence of the ink is determined while ink cartridge 3 is moved. Therefore, it is possible to accurately determine whether printing is possible or not in an actual printing operation.

Further, the position to which ink is jetted out for determining presence/absence of the ink is measured every time the ink cartridge is exchanged. Therefore, ink emission at an accurate position is possible, absorbing variation of nozzle position among the ink cartridges, and therefore it is possible to determine presence/absence of the ink accurately.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising:

a cartridge holder for holding an ink cartridge filled with ink;

an ink sensor provided at a known position within a recordable range of a sheet for sensing whether a sufficient amount of ink is available for printing; and a control unit for controlling said cartridge holder and said ink cartridge such that ink is emitted from a nozzle of said ink cartridge at a position of said ink sensor, while said cartridge holder is moved with a prescribed acceleration to determine whether a sufficient amount of ink is available for printing.

2. The image forming apparatus according to claim 1, further comprising means for detecting whether said ink cartridge is attached to said cartridge holder or not; wherein said control unit includes first means for causing ink emission from said nozzle of said ink cartridge near said ink sensor for calculating a distance between a normal position of said cartridge holder to said ink sensor, and means for controlling said cartridge holder and said ink cartridge such that ink is emitted from said nozzle of said ink cartridge at the position of said ink sensor while said cartridge holder is moved with a prescribed acceleration, based on the distance calculated by said first means.

3. The image forming apparatus according to claim 1, further comprising:

means for detecting whether or not said ink cartridge is attached to said cartridge holder; and a holder sensor provided between said ink sensor and a normal position of said cartridge holder for detecting passage of said cartridge holder; wherein said control unit includes first means for letting said nozzle of said ink cartridge to emit ink near said ink sensor, for calculating distance from said holder sensor to said ink sensor, and means for controlling said cartridge holder and said ink cartridge such that ink is emitted from said nozzle of said ink cartridge at the position of said ink sensor while said cartridge holder is moved with a prescribed acceleration based on the distance calculated by said first means.

4. A facsimile apparatus, comprising:

data preparing means for preparing data to be printed;

an image forming apparatus connected to said data preparing means for forming an image of said data; and data erasing means for erasing said data after the image is formed; wherein said image forming apparatus includes a cartridge holder for holding an ink cartridge filled with ink, an ink sensor provided at a known position within a recordable range of a sheet for sensing whether a sufficient amount of ink is available for printing, and a control unit for controlling said cartridge holder and said ink cartridge such that ink is emitted from said nozzle of said ink cartridge at a position of said ink sensor based on said data, while said cartridge holder is moved with a prescribed acceleration to determine whether a sufficient amount of ink is available for printing.

5. The facsimile apparatus according to claim 4, wherein said image forming apparatus further includes means for detecting whether said ink cartridge is attached to said cartridge holder or not; and said control unit includes first means for letting said nozzle of said ink cartridge to emit ink near said ink sensor, for calculating distance from a normal position of said cartridge holder to said ink sensor, and means for controlling said cartridge holder and said ink cartridge such that ink is emitted from said nozzle of said ink cartridge at a position of said ink sensor while said cartridge holder is moved with a prescribed acceleration based on the distance calculated by said first means.

6. The facsimile apparatus according to claim 4, wherein said image forming apparatus further includes means for detecting whether or not said ink cartridge is attached to said cartridge holder, and a holder sensor provided between said ink sensor and a normal position of said cartridge holder for detecting passage of said cartridge holder; and said control unit includes first means for letting said nozzle of ink cartridge to emit ink near said ink sensor, for calculating distance from said holder sensor to said ink sensor, and means for controlling said cartridge holder and said ink cartridge such that ink is emitted from said nozzle of said ink cartridge at the position of said ink sensor while said cartridge holder is moved with a prescribed acceleration based on the distance calculated by said first means.

7. A method of positioning an ink sensor used in an image forming apparatus including a cartridge holder for holding an ink cartridge filled with ink, an ink sensor provided at a known position within a recordable range of a sheet, and means for detecting whether said ink cartridge is attached to said cartridge holder, said method comprising the steps of:

when said ink cartridge is exchanged, moving said cartridge holder to an approximate position of said ink sensor from a normal position of said cartridge holder;

emitting ink from a nozzle of said ink cartridge while said cartridge holder is swung over a prescribed width;

detecting ink emission by said ink sensor;

finding distance from the normal position of said cartridge holder to said ink sensor based on a result of detection by said ink sensor;

emitting ink from said nozzle of said ink cartridge at a position of said ink sensor while said cartridge holder is moved with a prescribed acceleration; and determining presence of ink in said ink cartridge when said ink sensor senses ink emission.

8. A method of positioning an ink sensor used in an image forming apparatus including an ink cartridge filled with ink, a cartridge holder for holding said ink cartridge, an ink sensor provided at a known position within a recordable range of a sheet, a holder sensor provided between said ink sensor and a normal position of said cartridge holder for detecting passage of said cartridge holder, and means for detecting whether said ink cartridge is attached to said cartridge holder, said method comprising the steps of:

when said ink cartridge is exchanged, moving said cartridge holder from the normal position of said cartridge holder to an approximate position of said ink sensor;

detecting by said holder sensor, passage of said cartridge holder;

emitting ink from a nozzle of said ink cartridge while said cartridge holder is swung over a prescribed width;

detecting by said ink sensor, ink emission; and finding distance from said holder sensor to said ink sensor in accordance with the result of detection by said ink sensor; emitting ink from said nozzle of said ink cartridge at the position of said ink sensor while said cartridge holder is moved with a prescribed acceleration; and determining presence of ink in said ink cartridge when said ink sensor senses ink emission.

* * * * *